US010830555B2

(12) United States Patent
Harvey et al.

(10) Patent No.: US 10,830,555 B2
(45) Date of Patent: Nov. 10, 2020

(54) PROJECTILE LAUNCHING SYSTEM

(71) Applicants: Daniel D. Harvey, Lake Geneva, WI (US); James Tentes, Salem, WI (US)

(72) Inventors: Daniel D. Harvey, Lake Geneva, WI (US); James Tentes, Salem, WI (US)

( * ) Notice: Subject to any disclaimer, the term of this patent is extended or adjusted under 35 U.S.C. 154(b) by 251 days.

(21) Appl. No.: 15/821,306

(22) Filed: Nov. 22, 2017

(65) Prior Publication Data

US 2018/0142984 A1 May 24, 2018

Related U.S. Application Data

(60) Provisional application No. 62/425,744, filed on Nov. 23, 2016.

(51) Int. Cl.

| | |
|---|---|
| ***F41B 11/723*** | (2013.01) |
| ***F41B 11/721*** | (2013.01) |
| ***F41B 11/71*** | (2013.01) |
| ***F41B 11/62*** | (2013.01) |

(52) U.S. Cl.

CPC ..... *F41B 11/723* (2013.01); *F41B 11/62* (2013.01); *F41B 11/71* (2013.01); *F41B 11/721* (2013.01)

(58) Field of Classification Search

CPC ..... F41B 11/71; F41B 11/721; F41B 11/723
See application file for complete search history.

(56) References Cited

U.S. PATENT DOCUMENTS

| | | | | |
|---|---|---|---|---|
| 5,613,483 | A * | 3/1997 | Lukas | F41B 11/721 124/70 |
| 6,601,780 | B1 * | 8/2003 | Sheng | F41B 11/52 124/51.1 |
| 7,509,953 | B2 * | 3/2009 | Wood | F41B 11/68 124/73 |
| 7,931,018 | B1 * | 4/2011 | Lai | F41B 11/721 124/71 |
| 8,671,928 | B2 | 3/2014 | Hague et al. | |
| 2003/0005918 | A1 * | 1/2003 | Jones | F41B 11/57 124/70 |
| 2008/0011283 | A1 * | 1/2008 | Lai | F41B 11/721 124/73 |
| 2010/0012109 | A1 * | 1/2010 | Lai | F41B 11/721 124/77 |
| 2011/0232618 | A1 * | 9/2011 | Gabrel | F41B 11/723 124/73 |
| 2016/0033230 | A1 | 2/2016 | Lort | |

* cited by examiner

*Primary Examiner* — Gabriel J. Klein
(74) *Attorney, Agent, or Firm* — Andrus Intellectual Property Law, LLP

(57) ABSTRACT

A projectile launching system for pneumatically launching projectiles is disclosed. The projectile launching system includes a nozzle that is positioned within an engine body and movable between a rearward, loading position and a forward, firing position. A valve stem contained within the engine body is moveable to selectively control the discharge of pressurized gas to propel the projectile. The movement of the valve stem controls the supply of pressurized air to move the nozzle to the rearward, loading position upon firing of a projectile. A trigger assembly is used to selectively control the venting of pressurized air to atmosphere to control the movement of the valve stem within the projectile launching system.

11 Claims, 18 Drawing Sheets

PROJECTILE LAUNCHING SYSTEM

CROSS REFERENCE

The present application is based on and claims priority to U.S. Provisional Patent Application Ser. No. 62/425,794, filed on Nov. 23, 2016, the disclosure of which is incorporated herein by reference.

FIELD

The present disclosure relates to a projectile launching system. More specifically, the present disclosure relates to a projectile launching system that can be used in an airsoft gun.

BACKGROUND

Current airsoft projectile launching systems (as well as non-airsoft systems) include pneumatic and spring power sources. Each suffers from deficiencies affecting accuracy, usability and/or durability.

For example, current spring-powered launching systems use a compressed spring to drive a piston longitudinally within a cylinder, which compresses air in front of the piston. As the air is compressed, it is directed behind the projectile to launch the projectile from a barrel. The spring may be compressed by human power or by an electric motor. Due to the stresses applied by the compressed spring these types of systems are prone to mechanical failure. In addition to the deficiencies in durability, accuracy in spring powered systems is negatively affected by the impact of the piston at the end of its travel.

Pneumatic launching systems that offer independent control and timing of the nozzle and valve (stacked tube configuration) are bulky and thus will not fit into the space available for an airsoft gun. Examples of these systems are shown in U.S. Pat. No. 8,671,928 and US Patent Publication Number 2016/0033230.

SUMMARY

The present disclosure generally relates to a projectile launching system or engine for use with a pneumatic gun powered by a supply of pressurized gas. More specifically, the present disclosure relates to a projectile launching engine that utilizes a supply of pressurized gas to fire a projectile upon depression of the trigger of a trigger assembly.

In at least one embodiment, the projectile launching engine includes a body having a front bore and a central bore. The front bore receives a nozzle that is selectively moveable between a forward, firing position and a rearward, loading position. In the forward, firing position, the nozzle directs a supply of pressurized gas into contact with a projectile such that the projectile is fired from the pneumatic gun. In the rearward loading position, the nozzle is retracted such that another projectile can be received and readied for firing.

A valve stem is positioned within the central bore of the body and is moveable between a forward sealing position and a rearward position. In the forward sealing position, the valve stem prevents the pressurized gas from flowing through the nozzle. Upon depression of the trigger, the valve stem moves away from the forward sealing position and allows the supply of pressurized gas to flow through the nozzle and fire the projectile.

In the forward sealing position, a front sealing ring of the valve stem is in contact with a stationary cup to prevent the flow of pressurized gas into the nozzle. The stationary cup has an internal passageway that is in communication with the discharge chamber of the nozzle.

A holding chamber is formed in the central bore of the body between a backend of the valve stem and a back wall of the central bore. The holding chamber receives the supply of pressurized gas which creates a force to hold the front sealing ring of the valve stem in the forward sealing position.

Upon depression of the trigger, the pressurized gas contained within the discharge chamber is vented to atmosphere such that the holding force is removed from the valve stem. With the holding force removed, the pressurized gas contained within a pressure chamber forces the valve stem rearward. During this rearward movement, the front sealing ring moves away from the stationary cup, which allows the pressurized gas contained within the pressure chamber to flow through the stationary cup and into the nozzle. The sudden flow of pressurized gas into the nozzle causes the projectile to be fired from the pneumatic gun.

As the vale stem moves away from the forward sealing position, an intermediate sealing ring passes over an inlet port. As the intermediate sealing ring passes over the inlet port, the supply of pressurized gas flows into an air passageway that extends between the central bore that includes the valve stem and the front bore that includes the nozzle. The supply of pressurized air contained within the air passageway flows through an outlet port that is in fluid communication with the nozzle. The flow of pressurized air into the area between the nozzle and the front bore causes the nozzle to move rearward away from the forward firing position. The nozzle continues to move rearward until it reaches a loading position in which another projectile is pushed in front of the nozzle for subsequent firing.

Once the trigger is released, pressurized gas again flows into the holding chamber, which causes the valve stem to move forward into its forward sealing position. In the forward sealing position, the valve stem prevents the pressurized gas from entering the nozzle until the trigger is again pressed to initiate the firing sequence.

In one embodiment of the disclosure, the projectile launching engine includes a trigger assembly. The trigger assembly includes a trigger that, upon depression, causes the venting of the holding chamber. In one embodiment, the trigger assembly is an electro-mechanical device that utilizes a solenoid to vent the holding chamber. In another embodiment, the trigger assembly is an electromechanical assembly having a three-way valve. The three-way valve vents the holding chamber upon depression of the trigger, which allows the valve stem to move toward the rearward, firing position.

BRIEF DESCRIPTION OF THE DRAWINGS

The drawings illustrate the best mode presently contemplated of carrying out the disclosure. In the drawings.

DETAILED DESCRIPTION

Figure 1:
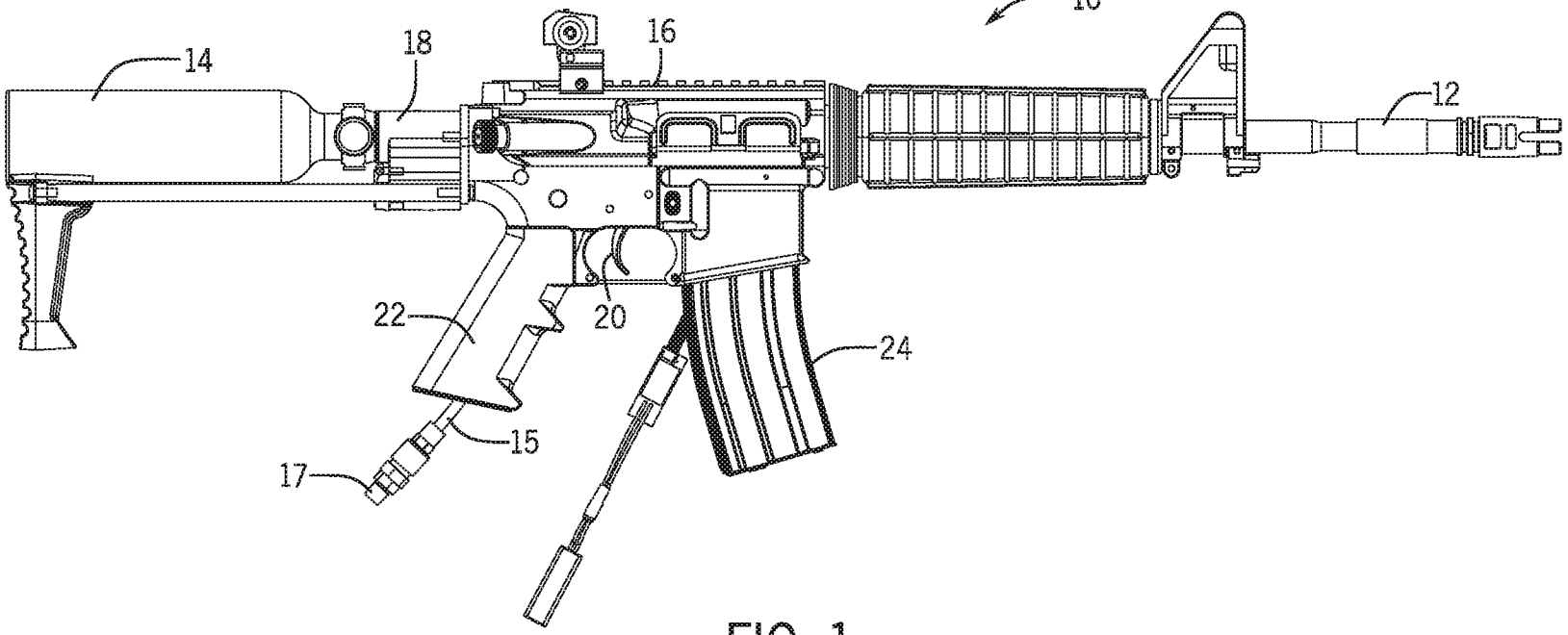
FIG. 1 is a side view of a airsoft gun incorporating the projectile launching system of the present disclosure.

FIG. 1 illustrates an airsoft gun 10 that is used to fire projectiles from a barrel 12. The airsoft gun 10 shown in FIG. 1 is configured to replicate the appearance of an AR-15 rifle. However, the configuration of the airsoft gun 10 can vary depending upon the selection by a user.

The airsoft gun 10 includes a bottle 14 of compressed gas that is fed into the main body 16 through a pressure regulator 18. This bottle 14 and pressure regulator 18 can be mounted either on the gun as shown or remotely held by or supported on the operator. In the embodiment shown in FIG. 1, a supply hose 15 and fitting 17 are shown for use in connecting a bottle of pressurized gas when supported by an operator. The pressurized gas could be air or carbon dioxide, or any other suitable gas. It should be understood that only one connection to a supply of pressurized gas would be used and that if the supply of pressurized gas were supported by the operator, the bottle 14 would be replaced by a conventional stock. When the operator pulls a trigger 20, the supply of pressurized gas is used to propel a projectile, which is often a plastic BB, through the barrel 12 toward a target.

The main body 16 shown in FIG. 1 includes a pistol grip 22 and an ammunition magazine 24 that includes the supply of projectiles.

Figure 2:
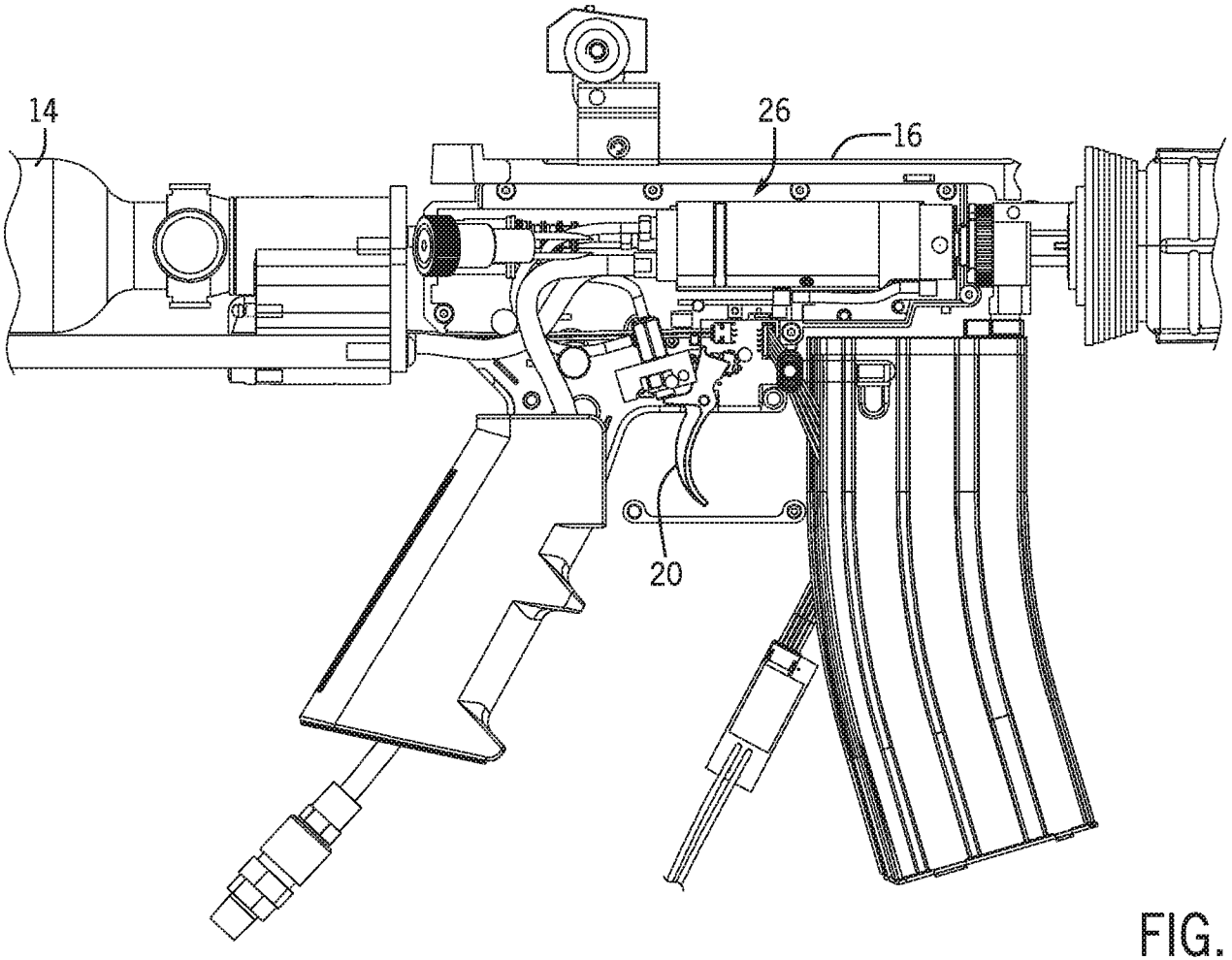
FIG. 2 is a magnified view of the launching system mounted within the airsoft gun.

Referring now to FIG. 2, a portion of the main body 16 is shown removed to illustrate the mounted position of a projectile launching system. The main body 16 of the airsoft gun is configured to receive the projectile launching system 26, which is often referred to as the "engine". The engine 26 operates to supply the pressurized air, at times controlled by the trigger 20, through an internal nozzle to propel projectiles from the airsoft gun 10. The engine 26 shown in FIG. 2 is a drop-in component that can be used to convert an electrical, spring based airsoft gun into an airsoft gun that can operate utilizing the supply of pressurized air.

Figure 3:
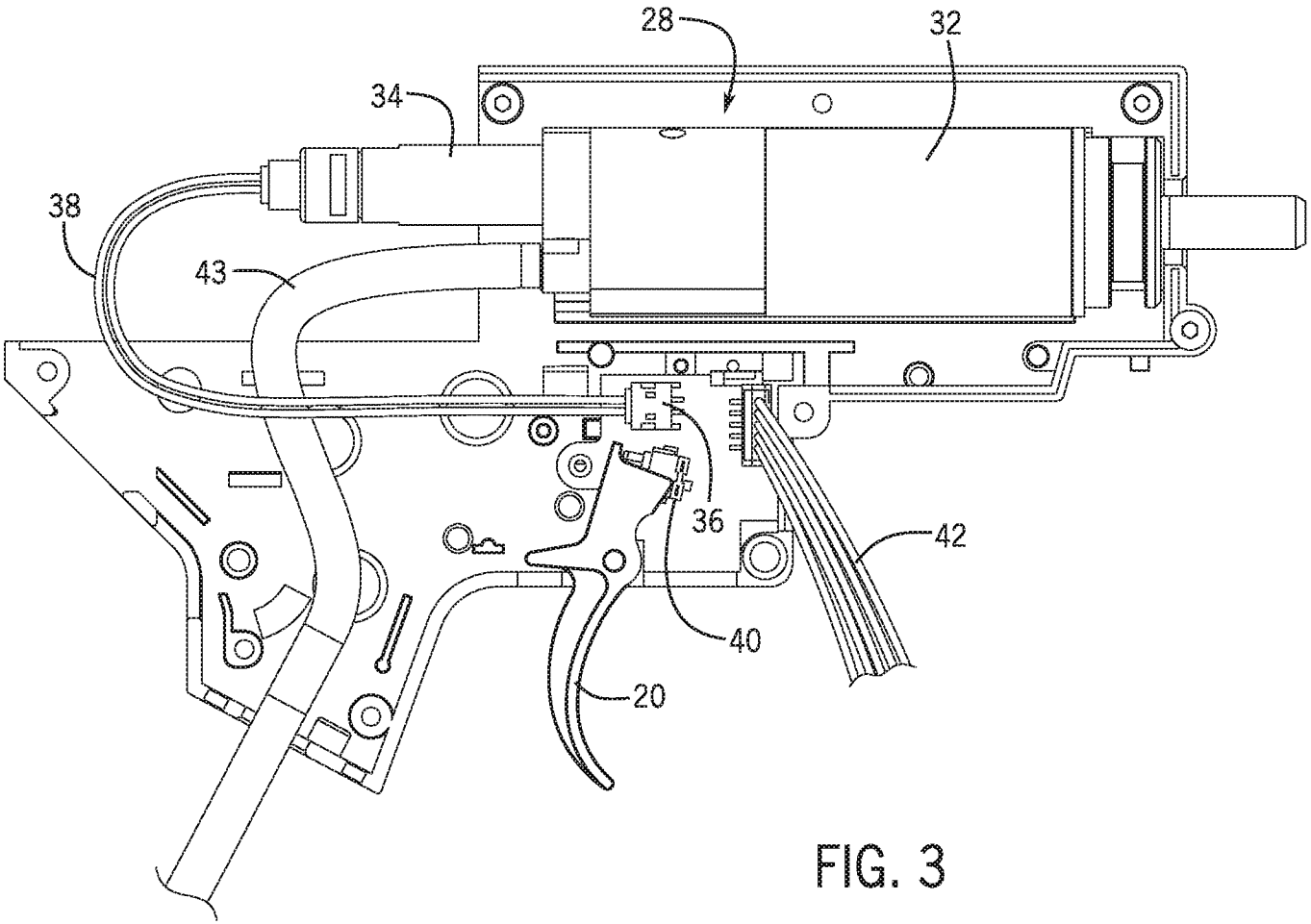
FIG. 3 is a magnified view of an electro-mechanical version of the launching system.
Figure 4:
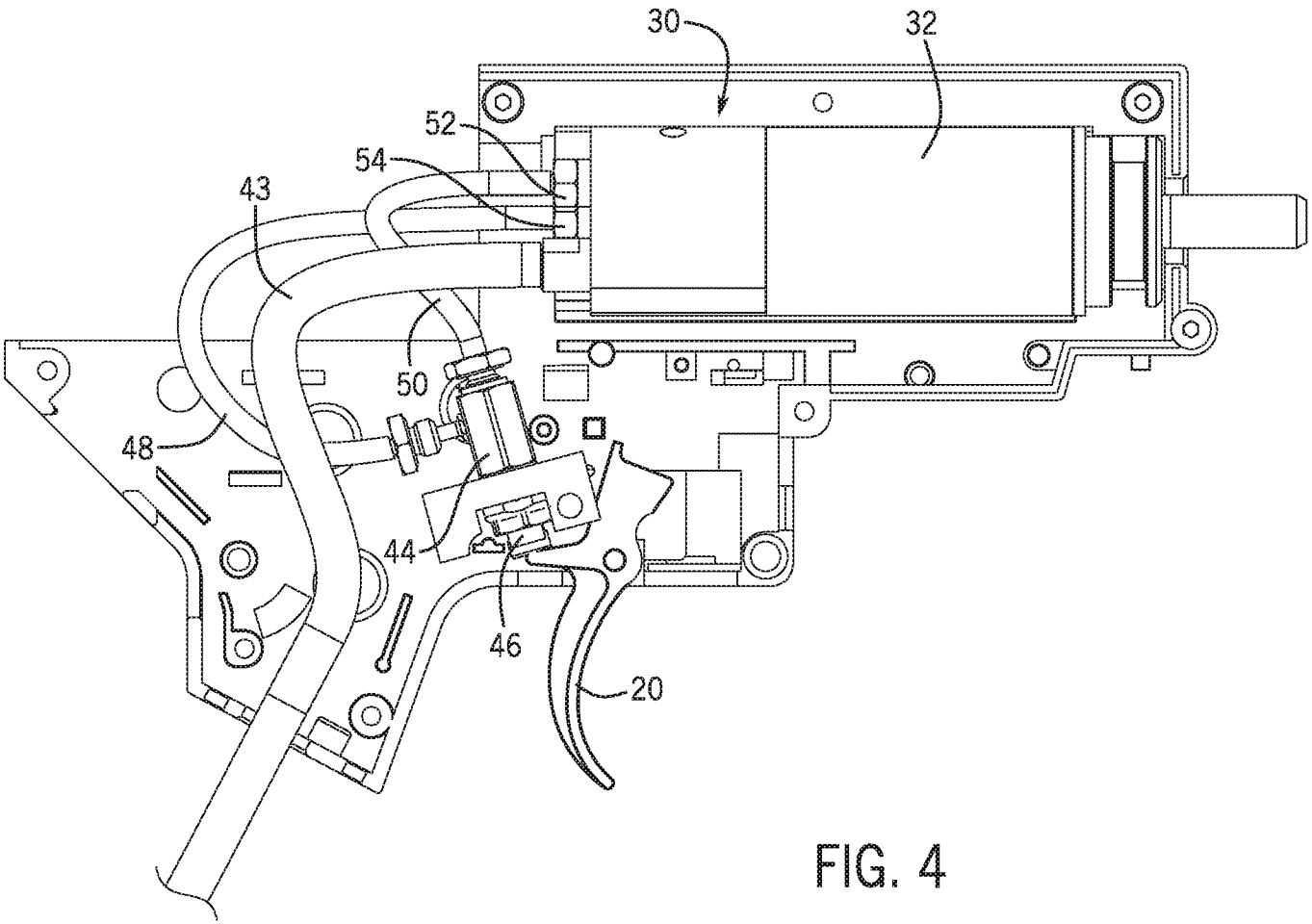
FIG. 4 is a magnified view of a mechanical version of the launching system.

FIG. 3 illustrates an electro-mechanical engine 28 while FIG. 4 illustrates a fully mechanical engine 30. The electro-mechanical engine 28 shown in FIG. 3 and the mechanical engine 30 shown in FIG. 4 differ only by the mechanisms used to supply and release the pressurized air into the main body 32. The main body 32, and its internal components, is identical in both embodiments of FIGS. 3 and 4.

The electro-mechanical engine 28 shown in FIG. 3 includes an electrically operated solenoid 34 that is operated by a trigger control board 36 through a pair of control lines 38. The engine 28 includes an electronically controlled pneumatic circuit including the solenoid 34. The solenoid 34 is a normally open (NO) component that must be energized to close. Thus, for the electro-mechanical engine 28 to operate, electric power must be present so that the solenoid 34 can be held in a closed position. When the trigger 20 is depressed, the trigger 20 engages a trigger sensor 40 which provides a signal to a controller (not shown) via the cabling 42. The controller generates electrical power via the cabling 42 to the trigger board 36 and the solenoid 34 to control the position of the electric solenoid 34. The position of the solenoid 34 is based upon the detected position of the trigger 20. The trigger board 36 shown interfaces with the firing controller through the cabling 42. The controller controls the timing of the solenoid movement, which thus controls the timing of the firing sequence described below. When the trigger 20 is pulled, electric power is applied to the solenoid 34 and the valve is moved to the closed (Vent) position. The supply of pressurized gas to the engine is shut off and the pressure is released from within the engine as will be discussed in detail below. A supply of electric power is provided to power the circuits and the solenoid 34 through the cabling 42. The opposite end of the cabling 42 includes a controller that further operates the electro-mechanical components of the engine. A supply of pressurized air is directed to the electro-mechanical engine 28 through the air supply hose 43. As described above, this pressurized air is from a stored air supply bottle that can either be mounted to the gun or carried by the user.

The mechanical engine 30 shown in FIG. 4 includes a similar trigger 20 that is used to control the position of a three-way valve 44 through the movement of the plunger 46. The engine 30 includes a mechanically controlled pneumatic circuit including the three-way valve 44. The three-way valve 44 is connected to first and second air hoses 48, 50 that are each received through one of a pair of fittings 52, 54 on the back of the body 32. The movement of the trigger 20 thus controls the position of the three-way valve 44 and allows air to be selectively vented from the engine 30. A supply of pressurized air is directed to the mechanical engine 30 through the air supply hose 43. As described above, this pressurized air is from a stored air supply bottle that can either be mounted to the gun or carried by the use.

FIGS. 5-12 illustrate the operational sequence of a first embodiment of the mechanical engine 30. However, it should be understood that the same operational sequence occurs when the electro-mechanical engine 28 is positioned within the body 16 of the airsoft gun. As indicated previously, the primary difference between the mechanical engine 30 and the electro-mechanical engine 28 occurs in the activation of the system to vent the compressed air from the engine body 32. The electro-mechanical engine 28 relies upon the solenoid 34 while the mechanical engine 30 relies upon the three-way valve 44 contained in the trigger assembly.

Figure 5A:
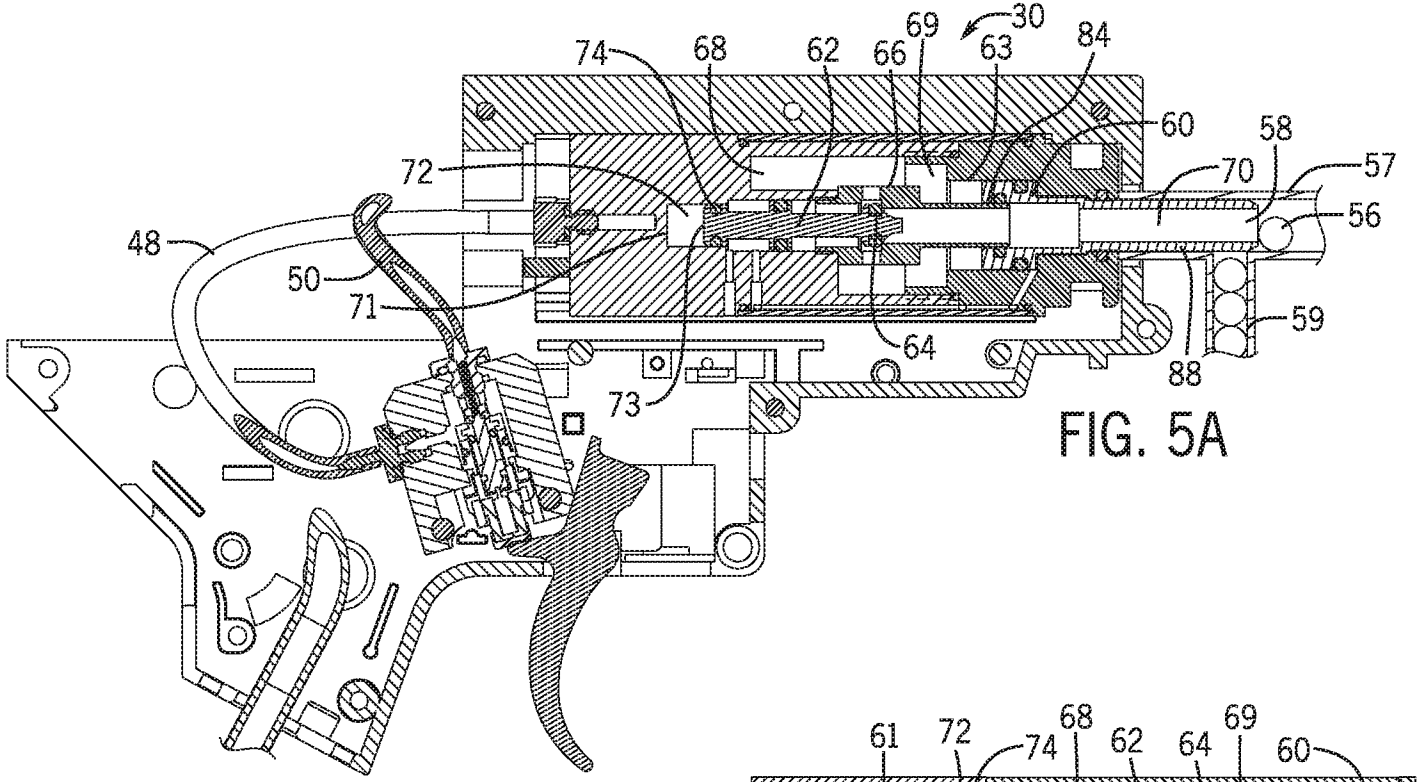
FIGS. 5*a* and 5*b* show the launching system ready to fire.
Figure 5B:
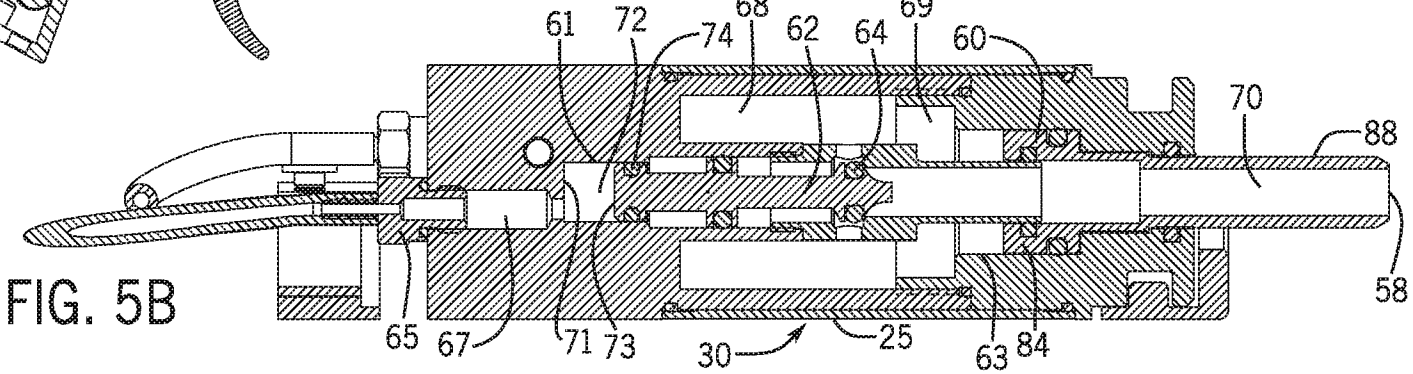

Referring now to FIGS. 5*a* and 5*b*, when the mechanical engine 30 is in its resting ready-to-fire position, a projectile 56 is positioned in front of the outlet opening 58 on the front barrel portion 88 of the nozzle 60. In this position, the front barrel portion 88 covers and blocks the top end of the projectile feed port 59 to prevent the stored projectiles from entering into the firing tube 57. The nozzle 60 includes the reduced diameter front barrel portion 88 and the expanded diameter sealing portion 84. The nozzle 60 is positioned within a front bore 63 and is movable within the front bore 63 between the forward firing position shown in FIG. 5*b* and a reward, loading position shown in 9*b*. The sequence of operation and movement of the nozzle 60 will be described below.

The firing sequence for both the mechanical engine 30 and the electro-mechanical engine is controlled by the movement and position of a valve stem 62. The valve stem 62 is formed from a metallic material and is movable within a central bore 61. In this ready-to-fire position of FIG. 5*b*, the valve stem 62 is positioned such that the front sealing ring 64 is sealed against the flat front surface of the stationary cup 66. The stationary cup 66 is threaded into the back portion of the body. When in this position, the pressurized gas supplied from the compressed gas source to the engine 30 fills the pressure chamber 68.

Figure 13:
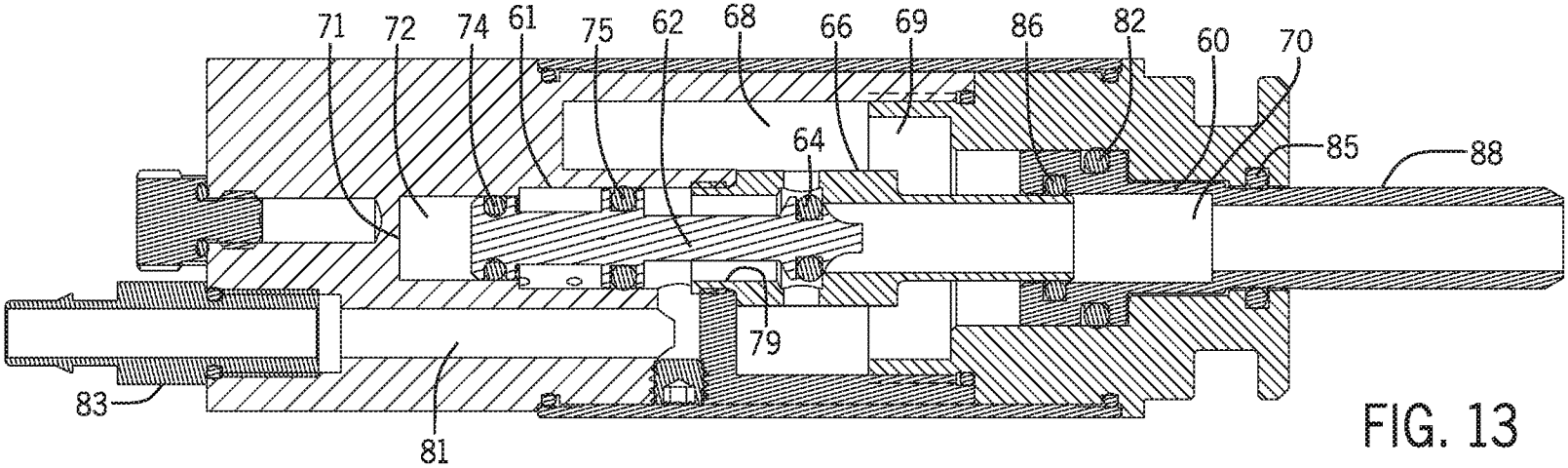
FIG. 13 is a top view showing the launching system.

As shown in FIG. 13, the air supply hose is received by the fitting 83 and is directed into the supply passageway 81 formed in the body of the engine 30. The supply of air flows past the valve stem 62 and fills the pressure chamber 68. The supply of air within the pressure chamber 68 is prevented from entering into the discharge chamber 70 in the nozzle 60 by the front sealing ring 64. The pressure chamber 68 generally surrounds the valve stem 62 and also includes an open front cavity 69 located in front of the valve stem 62. The open front cavity 69 expands the volume of pressurized air within the engine to aid in firing the projectile 56.

Referring back to FIG. 5*b*, during this ready-to-fire state, a supply of pressurized air is present in the holding chamber 72 located behind the back end 73 of the valve stem 62 and in front of a back wall 71 formed within the central bore 61 that receives the moving valve stem 62. The pressurized air is communicated to the holding chamber through the pair of air hoses 48, 50 and the three-way valve of the trigger assembly, which will be discussed in greater detail below. A rear sealing ring 74 formed near the back end of the valve stem 62 provides a fluid (air) barrier to prevent the leakage of the pressurized air from within the holding chamber 72. The supply of pressurized air within the holding chamber 72 forces the front sealing ring 64 into contact with the front face of the cup 66 to prevent the flow of air into the nozzle 60.

Figure 6A:
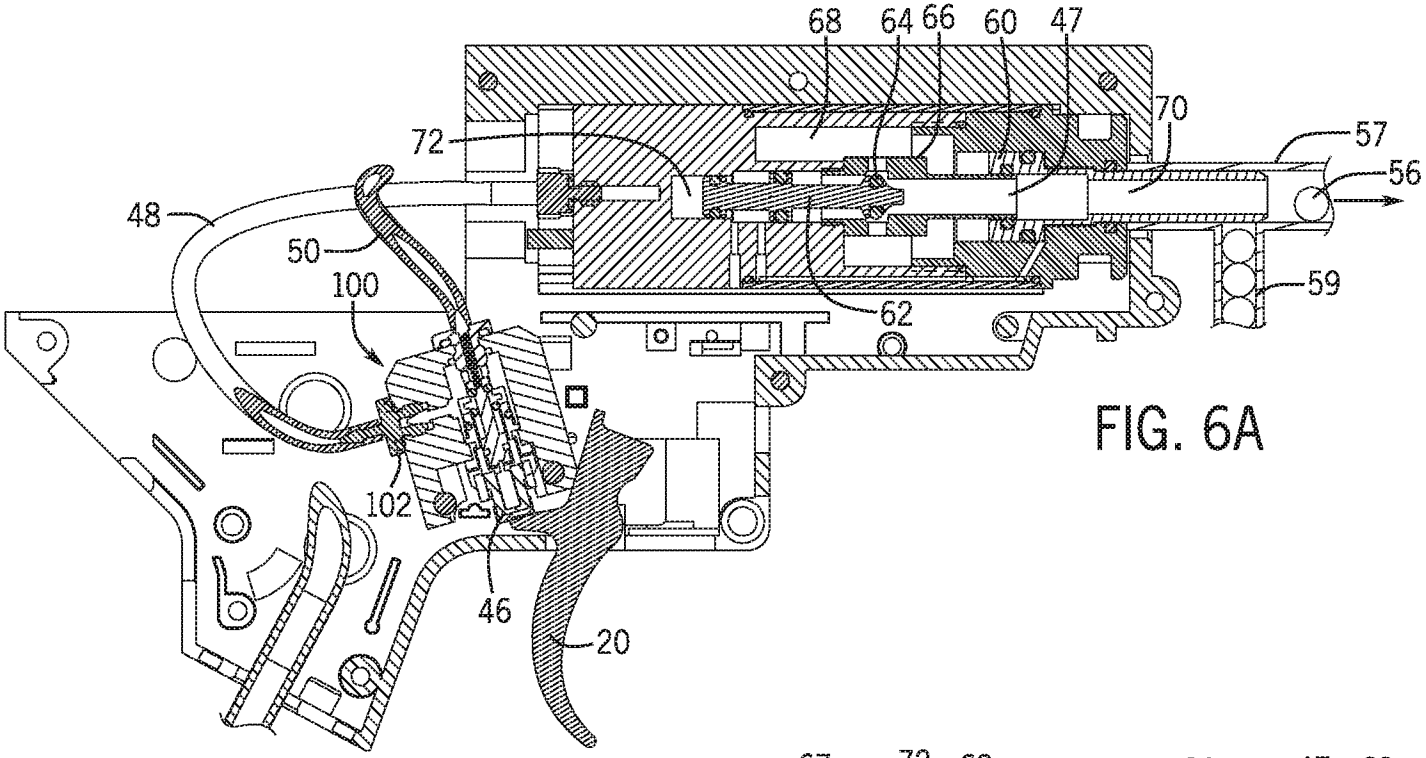
FIGS. 6*a* and 6*b* show the launching system with the trigger pulled and the start of the stem lifting from the base of the cup with the nozzle forward and the projectile ready to fire.
Figure 6B:
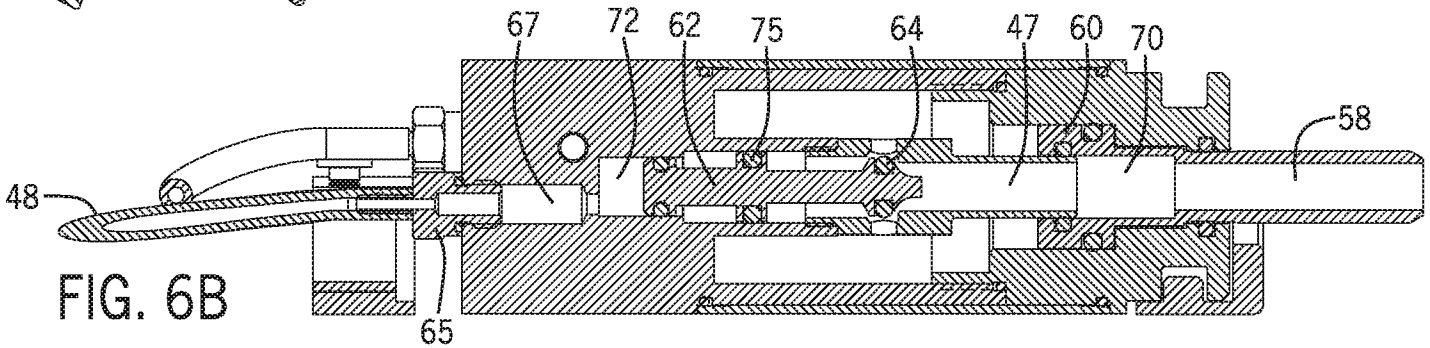

FIGS. 6*a* and 6*b* illustrate the condition when the trigger 20 of the trigger assembly has been pulled to initiate the firing sequence. When the trigger 20 is pulled, the plunger 46 of the trigger assembly moves, which causes the three-way valve to vent the compressed gas contained within the holding chamber 72 to atmosphere. The air contained within the holding chamber 72 flows to atmosphere through the vent passageway 67, the plug 65, and the air hose 48, as best shown in FIG. 6*b*. The air hose 48 is connected to the three-way valve of the trigger assembly 100 through the fitting 102 such that the pressurized air can be vented to atmosphere upon movement of an internal valve arrangement within the trigger assembly 100. Details of the operation of the trigger assembly 100 will be described in greater detail below with reference to FIGS. 16-18.

Once the supply of pressurized air is released from the holding chamber 72, the pressurized air contained within the pressure chamber 68 exerts a force on the intermediate sealing ring 75, which forces the valve stem 62 to move rearward. As the valve stem 62 begins to retract, the front sealing ring 64 moves away from the front surface of the stationary cup 66. As soon as the front sealing ring 64 moves away from the face surface of the stationary cup 66, the compressed air contained within the pressure chamber 68 enters into the open center portion 47 of the stationary cup 66. The pressurized air can then flow into the discharge chamber 70 of the nozzle 60, which causes the projectile 56 to be forced at a high rate of speed out of the barrel, as shown in FIG. 6A.

Figure 7A:
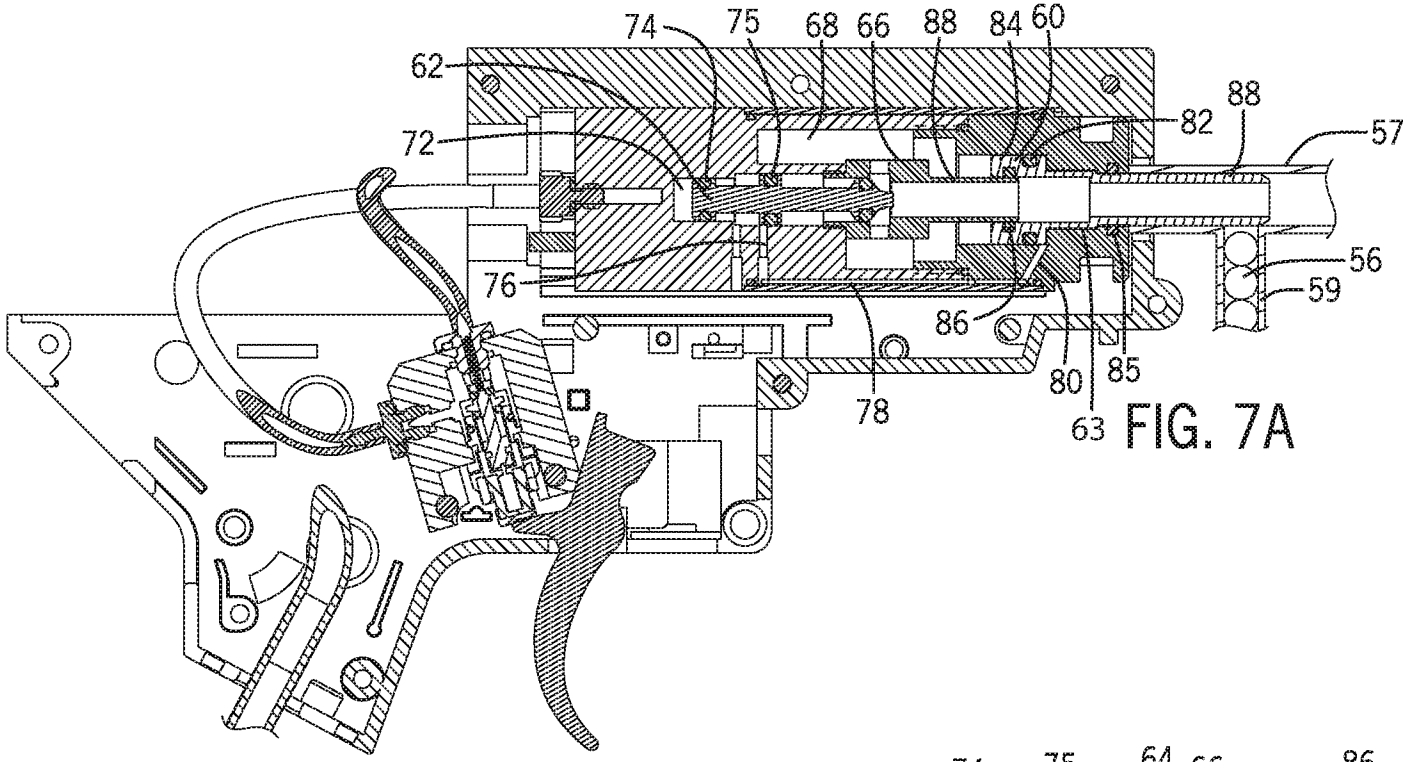
FIGS. 7*a* and 7*b* show the launching system with the stem about to travel past the nozzle port with the nozzle forward and the projectile moving down the barrel.
Figure 7B:
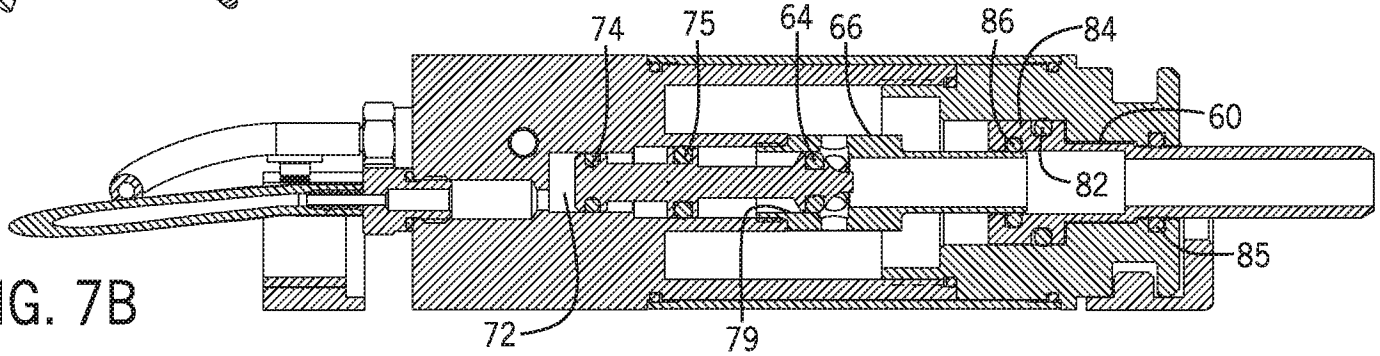

FIGS. 7*a* and 7*b* illustrate the further rearward movement of the valve stem 62 away from the cup 66 just before the intermediate sealing ring 75 formed on the valve stem 62 passes over the nozzle port 76. During this movement, the front sealing ring 64 contacts the inner surface 79 and creates a seal. As can be best seen in FIG. 13, the seal between the front sealing ring 64 and the inner surface 79 prevents the flow of pressurized gas from the inlet passageway 81 to the pressure chamber 68. Thus, when the valve stem 62 is in the position shown in FIG. 7*a*, the volume of gas in the pressure chamber 68 has been released and the flow of additional pressurized gas is prevented by the valve stem 62.

As can be seen in FIG. 7*a*, the nozzle port 76 communicates with an air passageway 78 that extends between the nozzle port 76 and an outlet 80. The outlet 80 communicates with the small area between the inner wall that defines the front bore 63 and the outer surface of the nozzle 60. The outlet 80 is positioned to the right of a sealing ring 82 that surrounds the expanded diameter portion 84 of the nozzle 60 and to the left of the sealing ring 85 surrounding the outer end of the nozzle 60. The pair of sealing rings 82 and 85 creates a sealed area surrounding the nozzle 60 that receives the pressurized gas from the outlet port 80. The nozzle 60 and the pair of sealing rings 82 and 85 are selected such that the force created to move the nozzle 60 away from the forward firing position shown in FIG. 7*b* is less than the force created to move the nozzle 60 toward the forward firing position. This allows the nozzle 60 to remain in the forward firing position until the projectile has been fully discharged from the gun barrel. An internal sealing ring 86 is formed within the nozzle 60 and travels along the outer surface of the barrel portion 88 of the cup 66 to maintain a fluid seal therebetween. In the position shown in FIG. 7*a*, the outer end of the barrel portion 88 of the nozzle 60 is still completely covering the projectile feed port 59 such that the next projectile 56 is still prevented from moving into the firing tube 57.

Figure 8A:
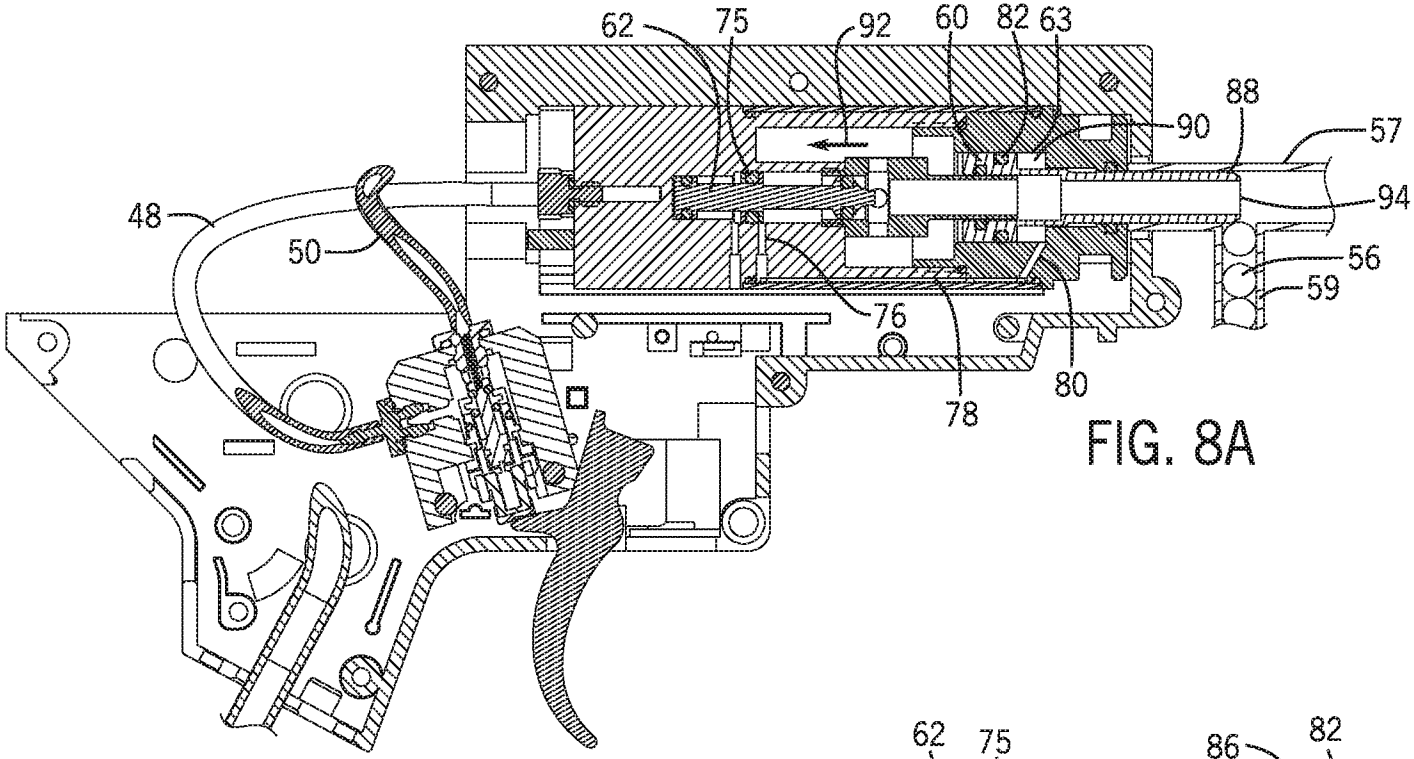
FIGS. 8*a* and 8*b* show the launching system with the stem moved past the nozzle port and the nozzle starting to retract.
Figure 8B:
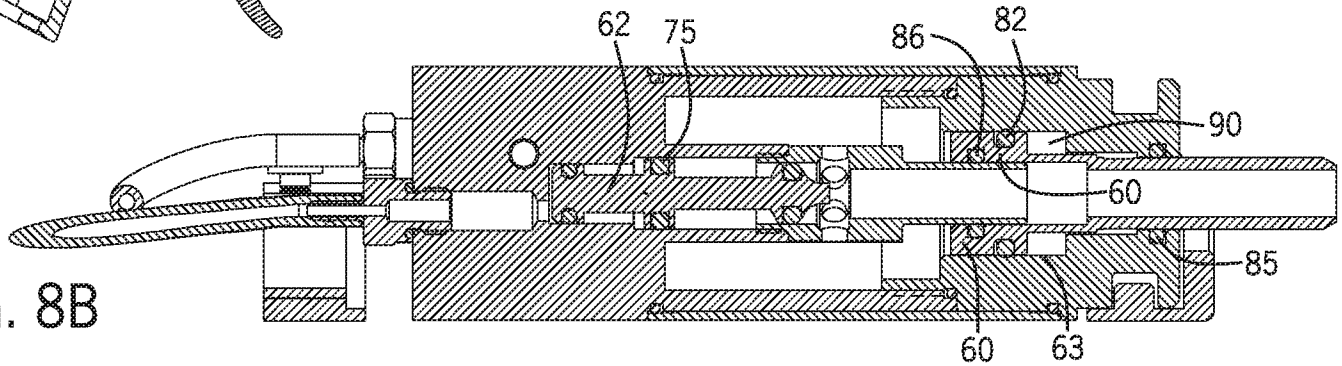

In the subsequent operational view shown in FIGS. 8*a*-8*b*, the valve stem 62 has moved further back until the intermediate sealing ring 75 travels completely past the nozzle port 76. Once the intermediate sealing ring 75 passes completely past the nozzle port 76, pressurized air flows into the passageway 78 from the nozzle port 76 and through the outlet port 80 into the area surrounding the outer surface of the nozzle 60 within the front bore 63. Once the pressurized air enters into this area, the pressurized air between the pair of sealing rings 82 and 85 begins to move the nozzle 60 rearward within the front bore 63 and creates an open cavity 90 in front of the nozzle 60. The rearward movement of the nozzle 60, as shown by arrow 92, retracts the outer end 94 of the barrel past the projectile feed port 59 such that the next projectile 56 can enter the firing tube 57 to be loaded for firing.

Figure 9A:
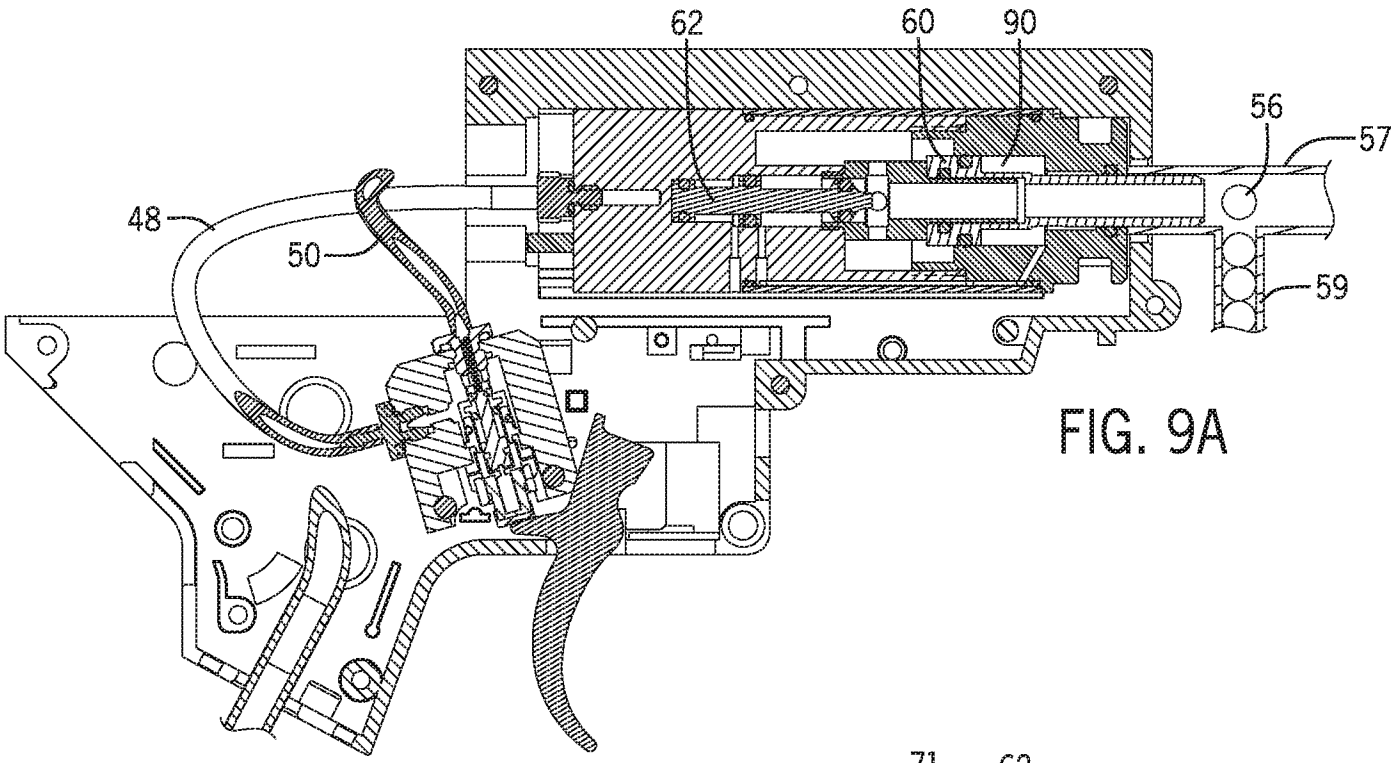
FIGS. 9*a* and 9*b* show the launching system with the stem fully retracted and the nozzle fully retracted to load another projectile.
Figure 9B:
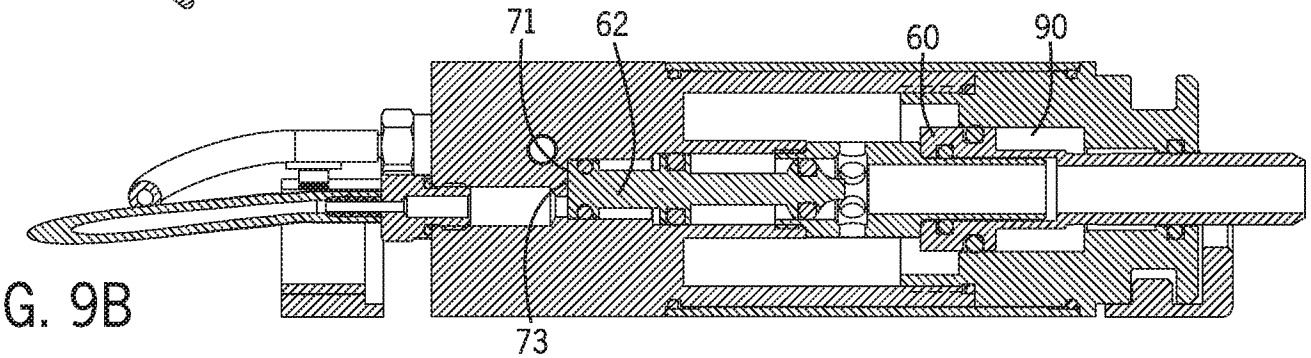

In FIGS. 9*a* and 9*b*, the valve stem 62 is in the fully rearward position and the nozzle 60 is in the fully rearward, loading position. When in this position, the back end 73 of the valve stem 62 is in contact with the back wall 71 and the holding chamber 72 is essentially eliminated. In this position, the nozzle is fully rearward such that the next projectile 56 is in position for firing.

Figure 10:
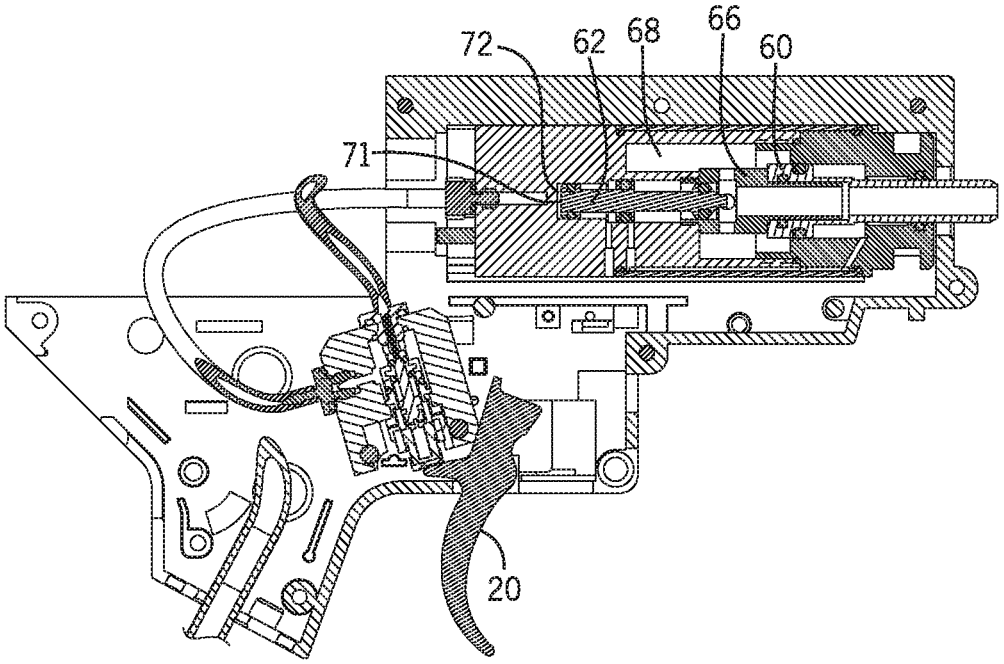
FIG. 10 shows the launching system with the trigger released and the stem starting to move forward.
Figure 11:
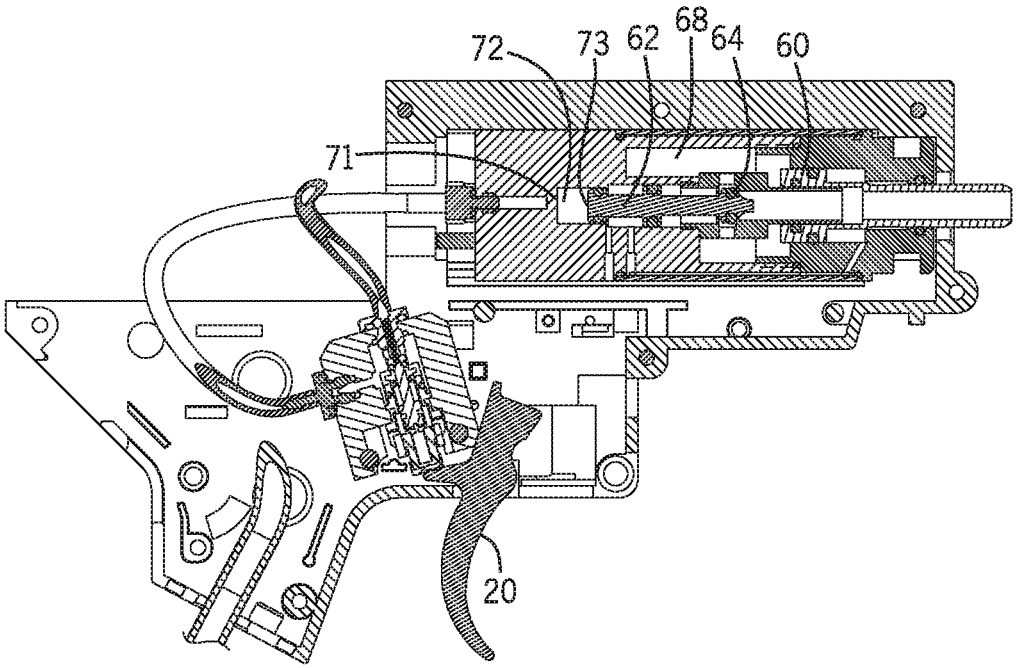
FIG. 11 shows the launch system with the stem moved past the nozzle port and the nozzle moving forward.
Figure 12:
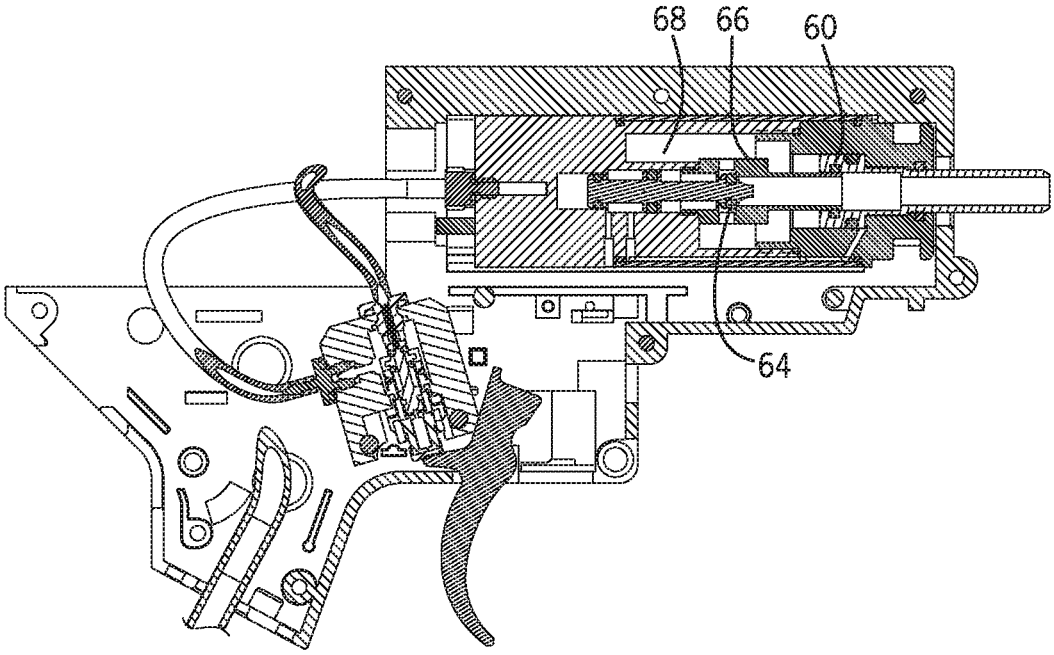
FIG. 12 is a view similar to FIG. 5*a* with the launching system ready to fire.

Referring now to FIGS. 10 and 11, once the trigger 20 is released, the three-way valve in the trigger assembly closes the vent to atmosphere and pressurized air builds up within the holding chamber 72 between the back end 73 of the valve stem 62 and the back wall 71, which causes the valve stem 62 to again move toward the cup 66. The valve stem 62 moves toward the cup 66 until the front sealing ring 64 again engages the outer surface of the cup 66. During this movement, the valve stem 62 moves out of engagement with the inner surface 79, which allows for the flow of pressurized gas back into the pressure chamber 68. Once the sealing ring 64 engages the surface of the cup 66, pressure returns to the pressure chamber 68 and the airsoft gun is again ready to fire another projectile 56. As can be understood in the drawing figures, the initial state shown in FIG. 5*a* corresponds to the state shown in FIG. 12 indicating that the airsoft gun is again ready to be fired.

As can be understood by the above-description, the supply of pressurized air contained within the fixed volume pressure chamber 68 is used to propel the projectile 56 while pressurized air in the passageway 78 retracts the nozzle 60 after firing.

Figure 14:
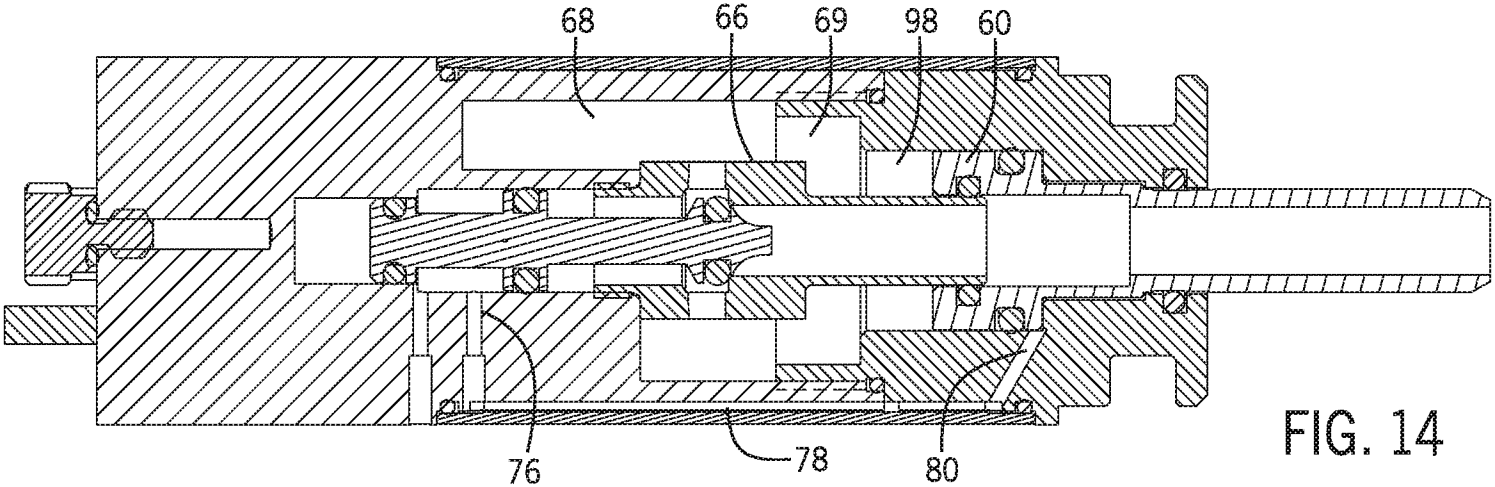
FIG. 14 is a section view shown the flow passageway to move the nozzle.

FIG. 13 is a magnified view illustrating the engine and the internal components previously described. As shown in FIG. 13, the full extent of the pressure chamber 68 that includes the front portion 69, extends in front of and to both sides of the cup 66. The size of the pressure chamber 68 increases the amount of pressurized air available to propel one of the projectiles. As illustrated in FIG. 14, the passageway 78 extends from the nozzle port 76 to the outlet 80. An open area 98 to the left of the nozzle 60 provides space for the movement of the nozzle 60 during the firing sequence.

Figure 15:
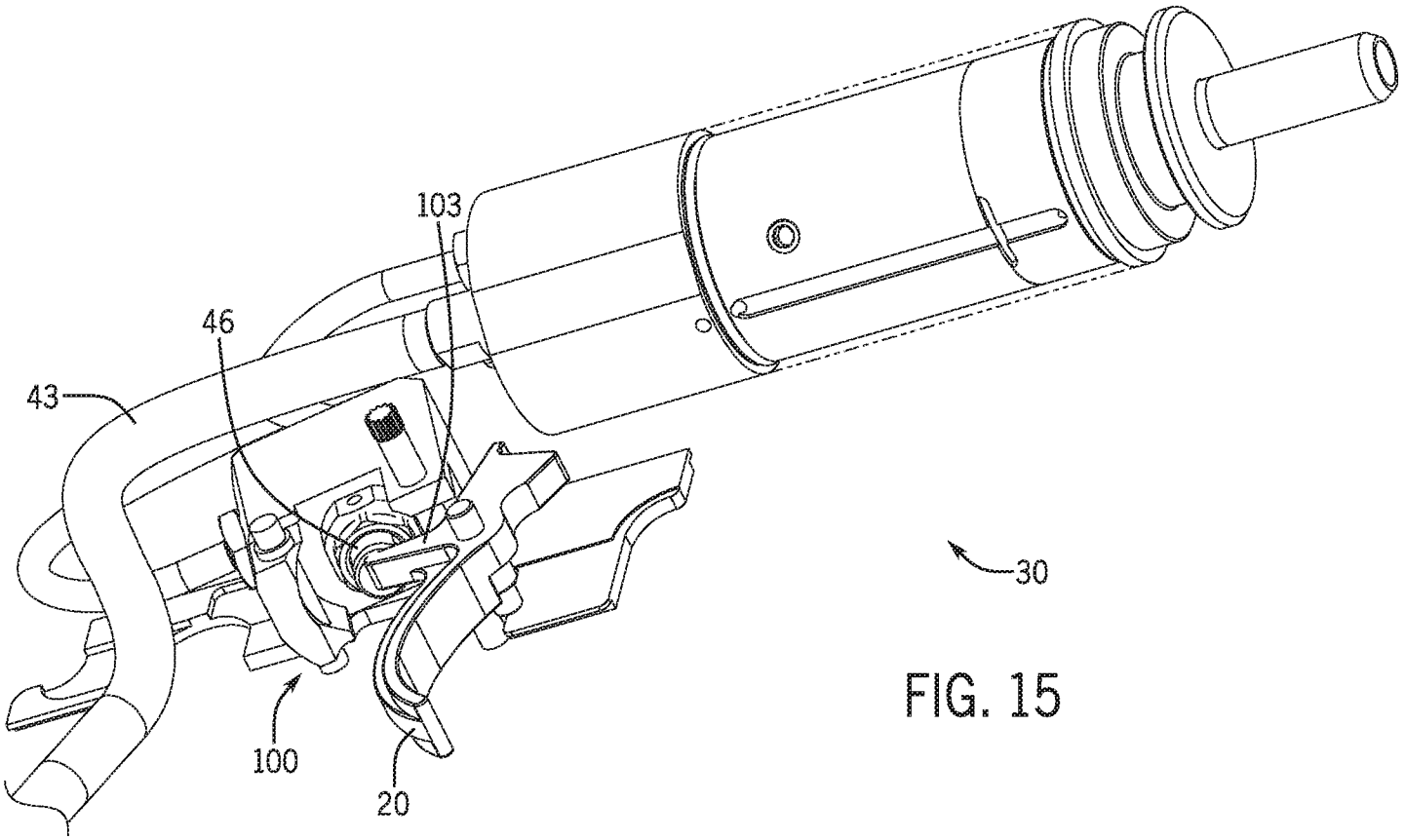
FIG. 15 is bottom view of the mechanical trigger assembly and launching system.

FIG. 15 illustrates a bottom view of the electro-mechanical engine 30 as used with the trigger assembly 100. As described previously, the trigger assembly 100 includes a moveable plunger 46 that is positioned to be engaged by a lever portion 103 on the trigger 20. The trigger assembly 100 includes internal structures such that the trigger assembly 100 functions as a three-way valve to control the air pressure within the engine 30. The operation of the trigger assembly 100 which will be described in detail below.

Figure 16:
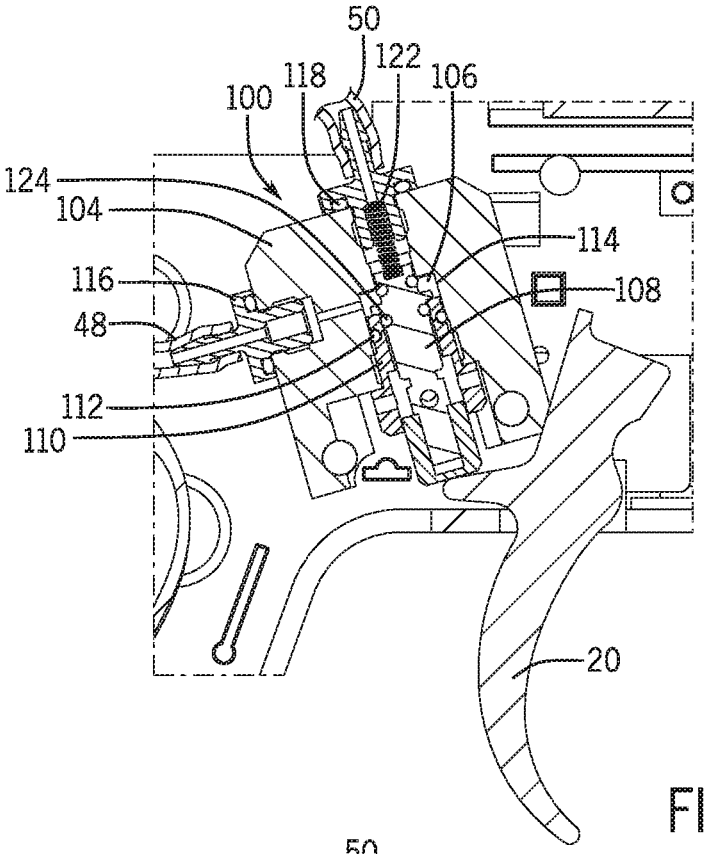
FIG. 16 is a section view of one version of the mechanical trigger assembly in the ready to fire condition.

Referring first to FIG. 16, thereshown is a section view of the trigger assembly 100 in the ready to fire, unactuated position. The trigger assembly 100 includes a main body 104 that includes an internal cavity 106 that receives a moveable valve stem 108. The valve stem 108 is moveable relative to a stationary internal sleeve 110. The internal sleeve 110 includes a outer sealing ring 112 that creates a fluid tight seal between the internal sleeve 110 and the inner wall 114 that defines the cavity 106. The trigger assembly 100 includes a fitting 116 that receives the air hose 48 while the fitting 118 receives the air hose 50. As illustrated in the view of FIG. 4, air hose 50 is in communication with the pressure chamber 68 while the air hose 48 is in communication with the holding chamber 72, which are both illustrated in FIG. 5*a*.

In the ready to fire state shown in FIG. 16, the air pressure within the air hose 50 along with the bias force created by spring 122 forces the valve stem 108 into the position shown in FIG. 16. In this position, the air pressure present in the holding chamber 72 is received within the cavity 106. The pressure in both of the air hoses 48 and 50 is the same in the ready to fire state shown in FIG. 16.

In this state, the sealing ring 112 formed on the outer surface of the internal sleeve 110 prevents the flow of air past the sleeve 110 while the lower sealing ring 124 surrounding the valve stem 108 prevents the passage of air between the valve stem 108 and the inner surface of the sleeve 110.

Figure 17:
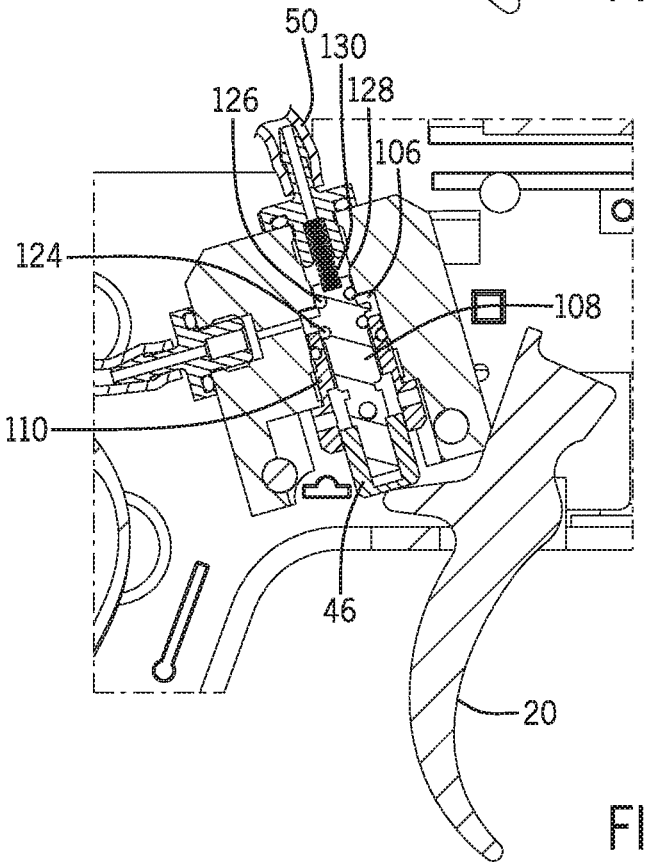
FIG. 17 is a section view similar to FIG. 16 showing the trigger in an intermediate position during depression.

Once the trigger begins to be depressed, as illustrated in FIG. 17, valve stem is physically moved upward and the upper sealing ring 126 begins to engage the inner wall 128 of the upper passage way 130 to seal the cavity 106 from the air pressure within the air hose 50.

Figure 18:
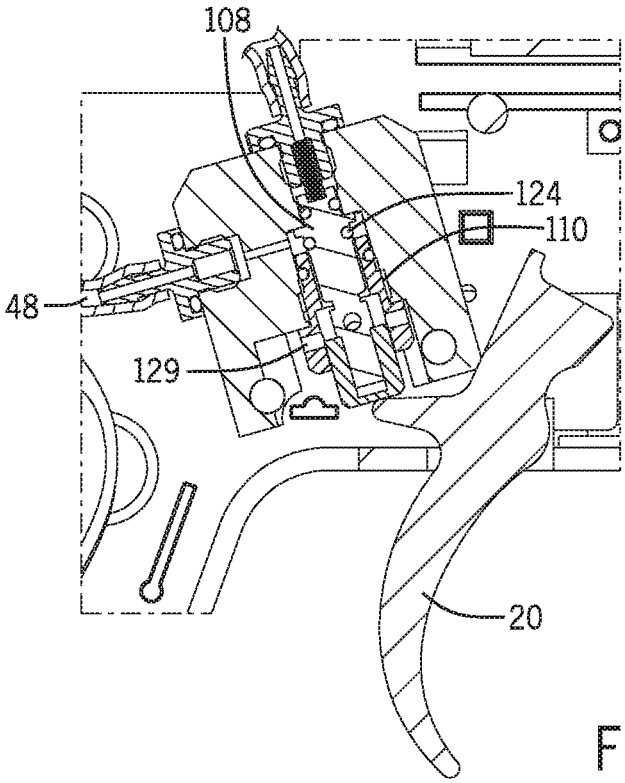
FIG. 18 is a section view showing the trigger in a fully actuated position.

As shown in FIG. 18, as the trigger continues to be depressed, the lower sealing ring 124 on the valve stem 108 exits the sleeve 110, which allows the free flow of air from the air hose 48 to pass between the outer surface of the valve stem 108 and the inner surface of the sleeve 110. This flow of air exits the vent openings 129 formed in the sleeve 110 and the air pressure in the air hose 48 is vented to atmosphere. Since the air hose 48 is connected to the holding chamber 72, such movement of the valve stem 108 vents the pressurized air in the holding chamber 72, which begins the firing sequence discussed above. At this point, a reduction in the air pressure resistance force against further movement of the plunger 46 is felt by the user.

Once the projectile has been fired, the operator can release the trigger 20 and the combination of the spring 122 and air pressure in the air hose 50 pushes the valve stem 108 back downward which again seals the flow passageway between the valve stem 108 and the sleeve 110, which re-pressurizes the holding chamber 72. At this point, the user will feel an increase in the trigger force needed to depress the trigger now that the cavity 106 is seeing pressure from the air hose 50 and the larger sealing ring 124 will contribute to the increased force. The sequence of operation repeats each time the trigger is depressed to initiate the firing of another projectile.

Figure 19:
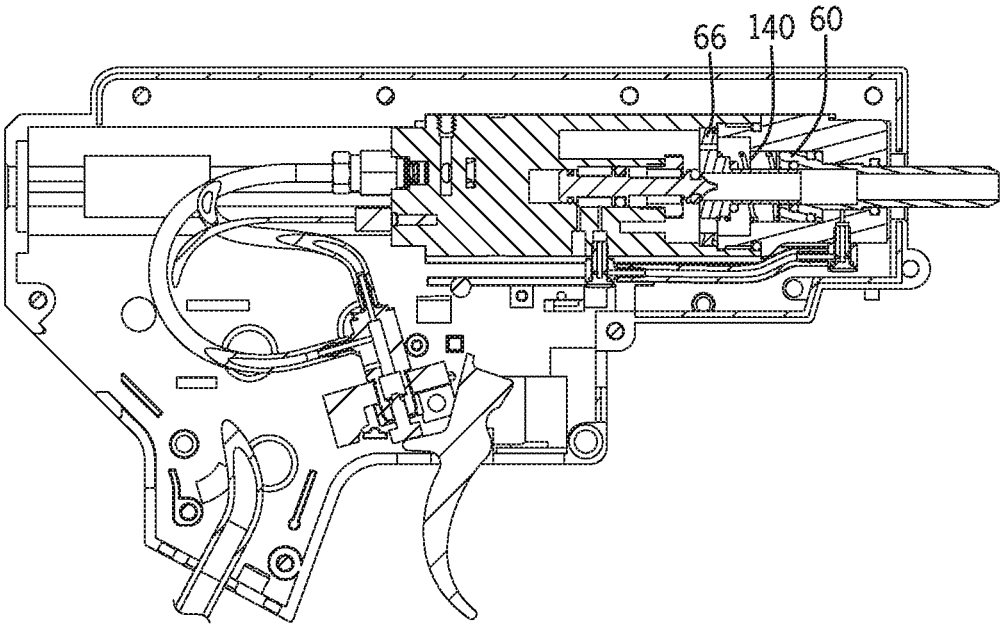
FIG. 19 is an alternate embodiment of the launching system.

FIG. 19 illustrates an alternate embodiment of the mechanical engine in accordance with another contemplated embodiment. In the embodiment shown in FIG. 19, a spring 140 is shown positioned between the nozzle 60 and the cup 66. The spring 140 creates a bias force that urges the nozzle 60 into its forward position shown in FIG. 19. The bias spring 140 is meant to aid in the assisting the forward motion of the nozzle and to delay the rearward movement of the nozzle 60 during the firing process.

Figure 20:
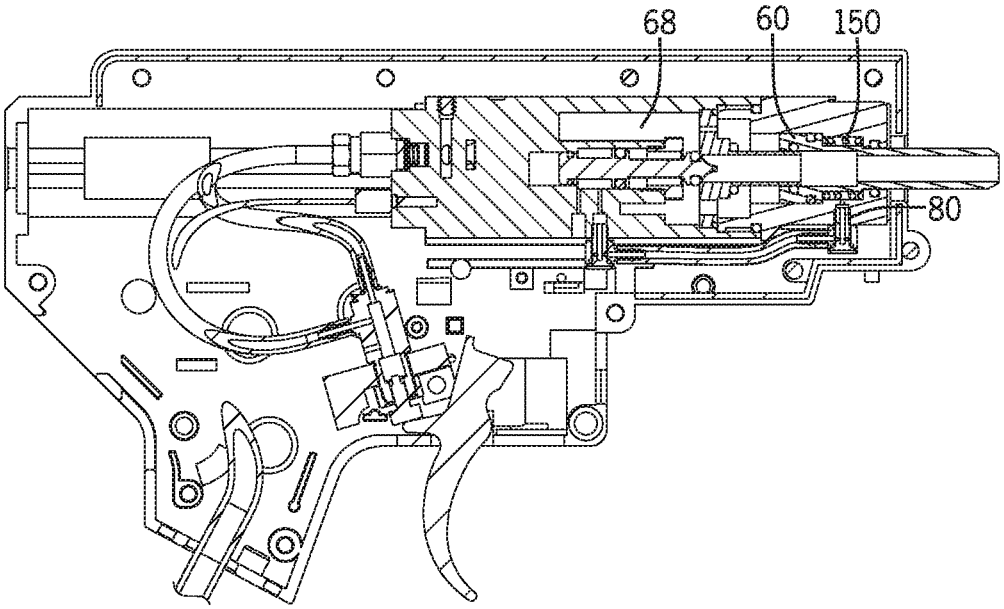
FIG. 20 is another alternate embodiment of the launching system.

FIG. 20 illustrates yet another embodiment in which a bias spring 150 is positioned in front of the nozzle 60. The bias spring 150 is used to create a bias force that helps urge the nozzle 60 rearward after the trigger has been depressed and the projectile has been fired. The spring force created by the bias spring 150 is in addition to the air pressure provided in front of the nozzle through the outlet 80.

Figure 21:
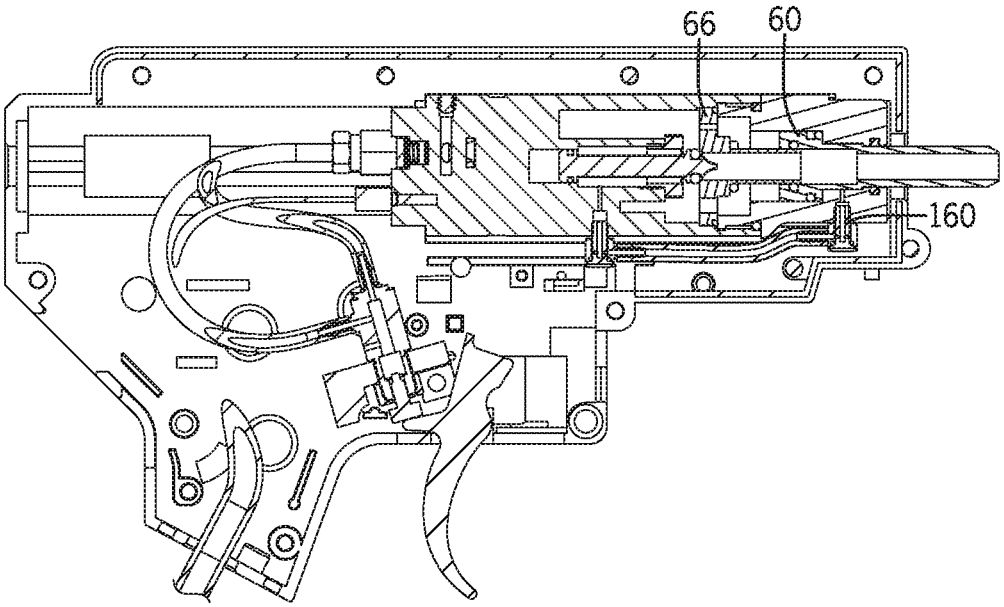
FIG. 21 is another alternate embodiment of the launching system.

FIG. 21 illustrates an embodiment in which a constant supply of air is presented to the front of the nozzle 60 through the fitting 160. The constant air to the front of the nozzle 60 eliminates the valving needed to turn on/off air to the nozzle. Since the pressurized air behind the nozzle is greater than the pressurized area in front of the nozzle, the nozzle will be driven forward by the pressurized air in the pressure chamber 68. However, when the pressure chamber 68 is vented through the nozzle, the air supply in front of the nozzle 60 will force the nozzle 60 rearward.

Figure 22:
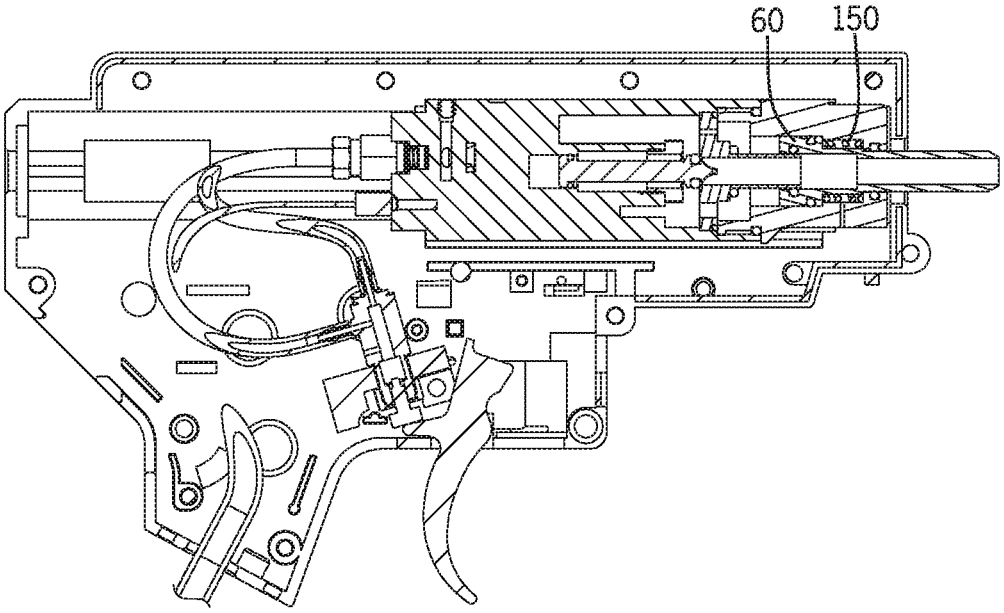
FIG. 22 is another alternate embodiment of the launching system.

FIG. 22 is an embodiment in which only the bias spring 150 is present in front of the nozzle and the supply of air has been removed. In this manner, the spring 150 is the only element used to drive the nozzle 60 rearward after the pressurized supply of air is used to propel the projectile.

Figure 23:
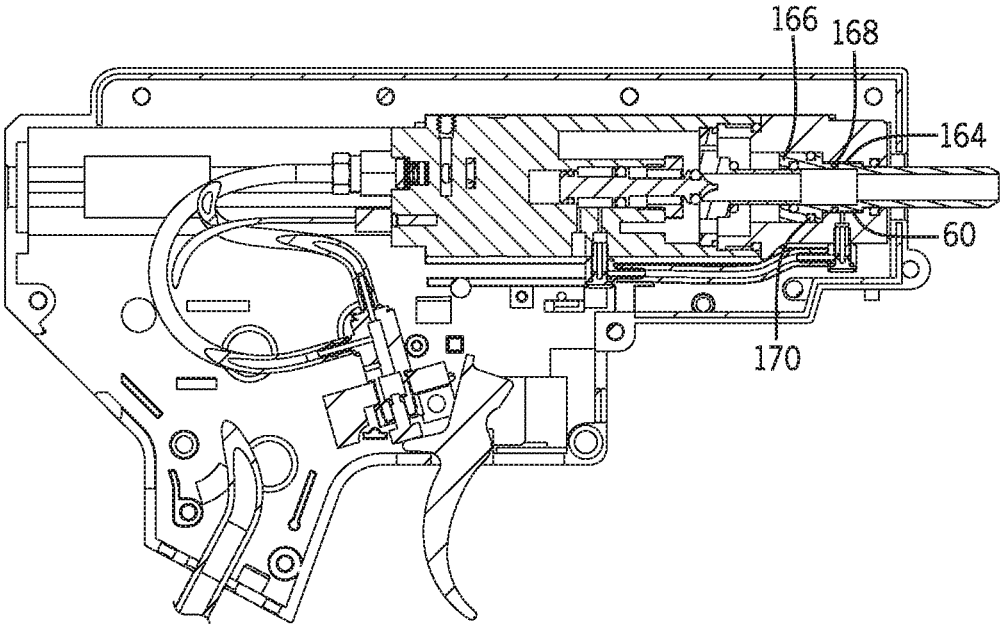
FIG. 23 is another alternate embodiment of the launching system.

FIG. 23 is an embodiment in which the nozzle 60 is designed to have a stepped outer surface including a first, reduced diameter portion 164 and a second, increased diameter portion 166. A first sealing ring 168 surrounds the reduced diameter portion 164 while a second sealing ring 170 surrounds the increased diameter portion 166. The smaller size of the first sealing ring 168 creates a smaller force when retracting the nozzle 60 as compared to the force created by the second sealing ring 170 during movement of the nozzle 60 forward to the forward firing position. During the movement of the nozzle 60 from the forward firing position shown, the air pressure on the first sealing ring 168 moves the nozzle 60 until the first sealing ring reaches the expanded diameter portion of the front bore at which time the first sealing ring is no longer in contact with the inner wall of the front bore. The air pressure then acts on the second sealing ring 170 to move the nozzle 60 to the rearward loading position.

As the above description indicates, the present disclosure includes a nozzle that is forward biased into a firing position. The system includes a forward/closed bolt operation that utilizes a single solenoid in the electro-mechanical version. In the mechanical version, the nozzle is forward biased as well. The system includes a combined spool (with stop) and poppet to release air from a chamber behind a sealing ring contained on the nozzle to control the nozzle movement. A feed hose and sized orifices (air path) to the nozzle retraction system is used to delay/slow the start of nozzle movement after firing. The poppet/spool valving is configured such that the valving delays beginning of the nozzle movement rearward. The poppet/spool also controls timing of the shut off of the air supply to the chamber. The system can be configured to isolate supply air from the chamber when fired or to partially flow supply air when the engine is fired. The system includes a fixed volume dump chamber to propel projectiles or can include a fixed volume chamber with partial flow through of supply air. The nozzle can be configured with either air or spring retract or a constant (supply) air to retract the nozzle.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A projectile launching engine for use in a pneumatic gun powered by a supply of pressurized gas, comprising:

a body including a front bore and a central bore;

a nozzle positioned within the front bore and movable between a forward firing position and a rearward loading position, the nozzle having an open discharge chamber;

a valve stem positioned within the central bore and movable between a forward sealing position and a rearward position, the valve stem including a front sealing ring, a rear sealing ring and an intermediate sealing ring positioned between the front sealing ring and the rear sealing ring;

a stationary cup having an internal passageway in communication with the discharge chamber; and a pressure chamber positioned around the stationary cup, wherein the pressure chamber receives the supply of pressurized gas;

an air passageway extending between the central bore and the front bore to selectively communicate the supply of pressurized gas from the central bore to the front bore to urge the nozzle toward the rearward position, wherein the air passageway includes an inlet port extending into the central bore and an outlet port extending into the front bore, wherein the intermediate sealing ring of the valve stem is positioned in front of the inlet port to prevent the flow of pressurized gas into the air passageway when the valve stem is in the forward sealing position and the intermediate sealing ring is positioned behind the inlet port to allow the flow of pressurized gas into the air passageway when the valve stem moves toward the rearward position, wherein the nozzle includes a first sealing ring and a second sealing ring positioned on opposite sides of the outlet port to create seals between the nozzle and the front bore;

wherein the front sealing ring of the valve stem contacts the stationary cup to prevent the passage of the supply of pressurized gas into discharge chamber when the valve stem is in the forward sealing position and the front sealing ring is spaced from the stationary cup to allow the passage of the supply of pressurized gas into the discharge chamber when the valve stem moves toward the rearward position.

2. The projectile launching engine of claim 1 further comprising a holding chamber formed in the central bore between a back end of the valve stem and a back wall of the central bore, wherein the holding chamber receives the supply of pressurized gas to hold the valve stem in the forward sealing position.

3. The projectile launching engine of claim 1 wherein the front sealing ring of the valve stem prevents the flow of pressurized gas into the pressure chamber when the valve stem is in the rearward position.

4. The projectile launching engine of claim 1 wherein a portion of the pressure chamber is located ahead of the valve stem.

5. A projectile launching engine for use in a pneumatic gun powered by a supply of pressurized gas, comprising:

a body including a front bore and a central bore;

a nozzle positioned within the front bore and movable between a forward firing position and a rearward loading position, the nozzle having an open discharge chamber;

a valve stem positioned within the central bore and movable between a forward sealing position and a rearward position, the valve stem including a front sealing ring and a rear sealing ring;

a stationary cup having an internal passageway in communication with the discharge chamber;

a pressure chamber positioned around the stationary cup, wherein the pressure chamber receives the supply of pressurized gas;

a holding chamber formed in the central bore between a back end of the valve stem and a back wall of the central bore, wherein the holding chamber receives the supply of pressurized gas to hold the valve stem in the forward sealing position; and a trigger assembly operable to vent the holding chamber upon movement of a trigger to an actuated position, wherein the front sealing ring of the valve stem contacts the stationary cup to prevent the passage of the supply of pressurized gas into discharge chamber when the valve stem is in the forward sealing position and the front sealing ring is spaced from the stationary cup to allow the passage of the supply of pressurized gas into the discharge chamber when the valve stem moves toward the rearward position.

6. The projectile launching engine of claim 5 wherein the holding chamber is vented through the trigger assembly.

7. The projectile launching engine of claim 5 wherein the trigger assembly includes a solenoid positioned to vent the holding chamber upon movement of the trigger to the actuated position.

8. The projectile launching engine of claim 5 wherein the trigger assembly includes a three-way valve operable to vent the holding chamber upon movement of the trigger to the actuated position.

9. The projectile launching engine of claim 5 further comprising a bias spring positioned to exert a bias force on the nozzle to urge the nozzle into the forward firing position.

10. The projectile launching engine of claim 5 further comprising a bias spring positioned to exert a bias force on the nozzle to urge the nozzle into the rearward loading position.

11. A projectile launching engine for use in a pneumatic gun powered by a supply of pressurized gas, comprising:

a body including a front bore and a central bore;

a nozzle positioned within the front bore and movable between a forward firing position and a rearward loading position, the nozzle having an open discharge chamber;

a valve stem positioned within the central bore and movable between a forward sealing position and a rearward position, the valve stem including a front sealing ring and a rear sealing ring;

a stationary cup having an internal passageway in communication with the discharge chamber; and a pressure chamber positioned around the stationary cup, wherein the pressure chamber receives the supply of pressurized gas;

wherein the front sealing ring of the valve stem contacts the stationary cup to prevent the passage of the supply of pressurized gas into discharge chamber when the valve stem is in the forward sealing position and the front sealing ring is spaced from the stationary cup to allow the passage of the supply of pressurized gas into the discharge chamber when the valve stem moves toward the rearward position, wherein the supply of pressurized gas in the pressure chamber moves the valve stem away from the forward sealing position and moves the nozzle toward the rearward loading position.

* * * * *